US008678531B2

(12) United States Patent
Kusunoki

(10) Patent No.: US 8,678,531 B2
(45) Date of Patent: Mar. 25, 2014

(54) DRIVING APPARATUS AND DRIVING METHOD OF INKJET HEAD

(75) Inventor: Ryutaro Kusunoki, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 194 days.

(21) Appl. No.: 13/224,201

(22) Filed: Sep. 1, 2011

(65) Prior Publication Data

US 2012/0062633 A1 Mar. 15, 2012

(30) Foreign Application Priority Data

Sep. 9, 2010 (JP) ..... 2010-202161
Aug. 29, 2011 (JP) ..... 2011-185791

(51) Int. Cl.
*B41J 29/38* (2006.01)

(52) U.S. Cl.
USPC ..... 347/11; 347/68

(58) Field of Classification Search
USPC ..... 347/9–11, 68–71
See application file for complete search history.

(56) References Cited

U.S. PATENT DOCUMENTS 7,195,327 B2 * 3/2007 Kitami et al. ..... 347/11
2008/0252672 A1 * 10/2008 Komai ..... 347/11

FOREIGN PATENT DOCUMENTS

JP 10-016212 1/1998
JP 2007-118294 5/2007

* cited by examiner

*Primary Examiner* — Julian Huffman
*Assistant Examiner* — Sharon A Polk
(74) *Attorney, Agent, or Firm* — Patterson & Sheridan, L.L.P.

(57) ABSTRACT

According to one embodiment, a driving apparatus of an inkjet head includes a drive signal output unit, an ejection pulse number decision unit, a pulse addition determination unit, and a drive signal generation unit. The ejection pulse number decision unit decides the number of ejection pulses based on a gradation value of print data. When the pulse addition determination unit has determined that the control pulse is not to be added, the drive signal generation unit generates a drive signal including ejection pulses whose number has been decided by the ejection pulse number decision unit. When the pulse addition determination unit has determined that the control pulse is to be added, the drive signal generation unit generates a drive signal including ejection pulses whose number is smaller than the number decided by the ejection pulse number decision unit.

14 Claims, 7 Drawing Sheets

42

| Gradation value | Evaluation value | | |
|---|---|---|---|
| | Three cycles before | Two cycles before | One cycle before |
| 0 | 4 | 6 | 10 |
| 1 | 2 | 3 | 5 |
| 2 | 0 | 0 | 0 |
| 3 | -2 | -3 | -5 |
| 4 | -4 | -6 | -10 |

DRIVING APPARATUS AND DRIVING METHOD OF INKJET HEAD

CROSS-REFERENCE TO RELATED APPLICATIONS

This application is based upon and claims the benefit of priority from prior Japanese Patent Applications No. 2010-202161, filed on Sep. 9, 2010; and No. 2011-185791, filed on Aug. 29, 2011, the entire contents of all of which are incorporated herein by reference.

FIELD

Embodiments described herein relate generally to a driving apparatus and a driving method of a shared-wall-type inkjet head.

BACKGROUND

There has been known an inkjet head that uses shear deformation of a piezoelectric member to eject ink drops from nozzles. Such an inkjet head is a so-called shared-wall-type inkjet head and mainly used in an inkjet printer. The shared-wall-type inkjet head enables so-called multi-drop gradation printing by effecting control so that one or more ink drops can be ejected from the nozzles in accordance with a gradation.

However, the shared-wall-type inkjet head has a problem that volumes of ink drops ejected from the nozzles differ and high-quality printing cannot be carried out when the gradation printing is performed.

DETAILED DESCRIPTION

In general, according to one embodiment, a driving apparatus of an inkjet head includes a drive signal output unit, an ejection pulse number decision unit, a pulse addition determination unit, and a drive signal generation unit.

The drive signal output unit outputs to an actuator a drive signal including ejection pulses which are used to generate pressure oscillation for ejecting ink drops from a nozzle in a pressure chamber associated with this nozzle. The ejection pulse number decision unit decides the number of ejection pulses based on a gradation value of print data. The pulse addition determination unit determines whether a control pulse for intensifying the pressure oscillation is to be added to the drive signal including the ejection pulses.

When the pulse addition determination unit has determined that the control pulse is not to be added, the drive signal generation unit generates a drive signal including ejection pulses whose number has been decided by the ejection pulse number decision unit. When the pulse addition determination unit has determined that the control pulse is to be added, the drive signal generation unit generates a drive signal including ejection pulses whose number is smaller than the number decided by the ejection pulse number decision unit.

An embodiment of a driving apparatus and a driving method of a shared-wall-type inkjet head will now be described hereinafter with reference to the drawings.

Figure 1:
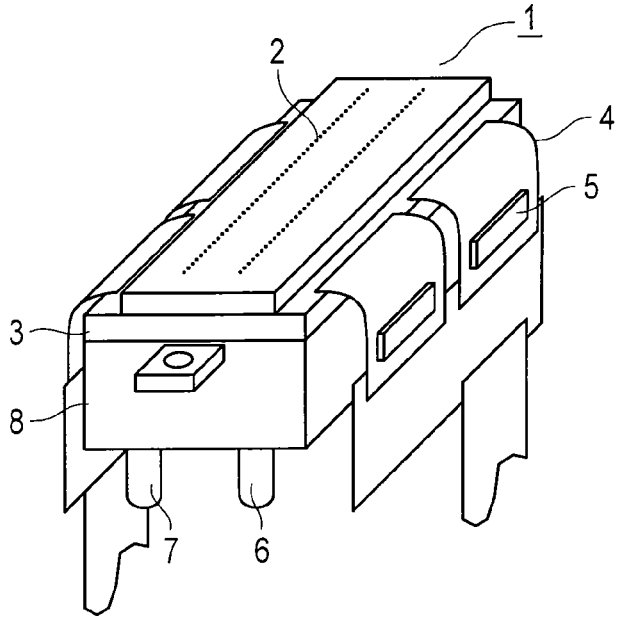
FIG. 1 is a perspective view of an inkjet head according to an embodiment.

FIG. 1 is a perspective view of an inkjet head 1. The inkjet head 1 is constituted of a head main body 3 including nozzles 2, a head drive unit 5 having a driver IC 4 mounted thereon, and a manifold 8 including an ink supply opening 6 and an ink ejection opening 7.

The inkjet head 1 ejects an ink, which is supplied from the ink supply opening 6, from the nozzles 2 in accordance with a drive signal generated from the driver IC 4. Further, the inkjet head 1 ejects from the ink ejection opening 7 an ink which has not been ejected from the nozzles 2 in the ink which has flowed in from the ink supply opening 6.

Figure 2:
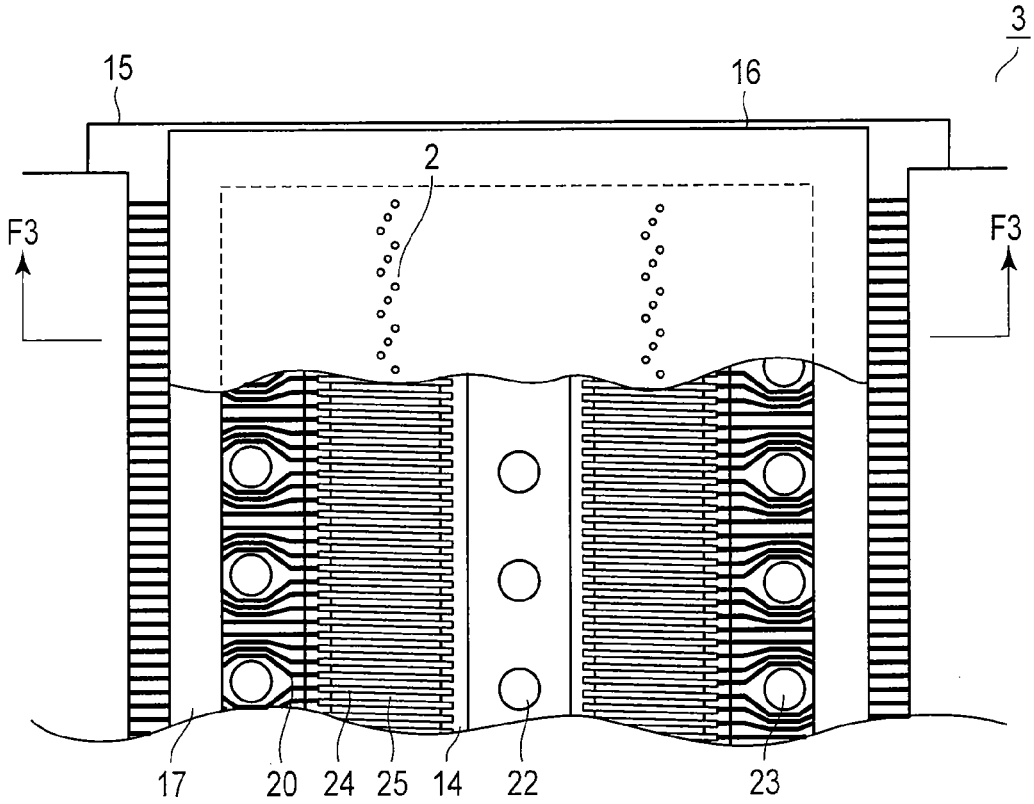
FIG. 2 is a plan view of a head main body in the inkjet head.
Figure 3:
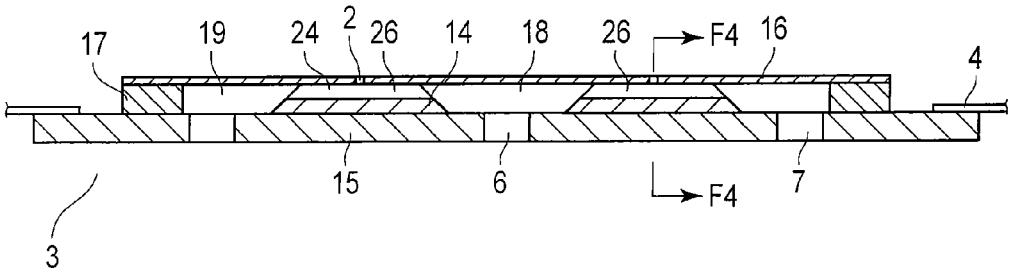
FIG. 3 is a longitudinal cross-sectional view of the head main body.
Figure 4:
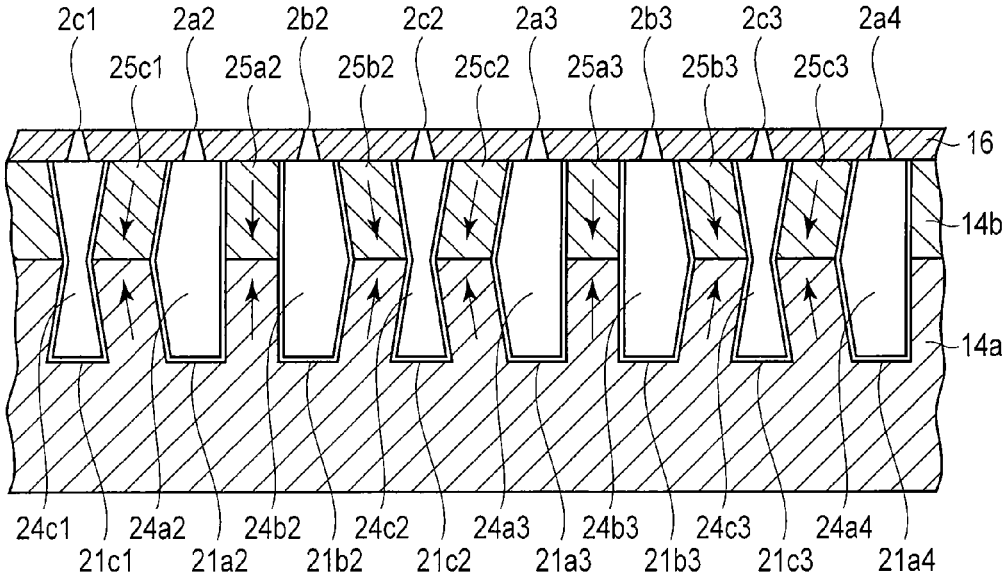
FIG. 4 is a transverse cross-sectional view of the head main body.

FIG. 2 is a plan view of the head main body 3, FIG. 3 is a longitudinal cross-sectional view of the head main body 3 taken through a line F3-F3 as indicated by arrow heads in FIG. 2, and FIG. 4 is a transverse cross-sectional view of the head main body 3 taken through a line F4-F4 as indicated by arrow heads in FIG. 3.

The head main body 3 has a base substrate 15 as a base. Furthermore, in the head main body 3, a frame member 17 is joined and connected to the upper side of this base substrate 15, and a piezoelectric member 14 is joined and connected in the frame member 17.

In the head main body 3, a nozzle plate 16 is bonded to the upper side of the frame member 17. Moreover, in the head main body 3, a space in a central part surrounded by the base substrate 15, the piezoelectric member 14, and the nozzle plate 16 is used as an ink supply path 18. Additionally, in the head main body 3, a space in a peripheral part surrounded by the base substrate 15, the piezoelectric member 14, the frame member 17, and the nozzle plate 16 is used as an ink ejection path 19.

Holes 22 communicating with the ink supply path 18 and holes 23 communicating with the ink ejection path 19 are formed in the base substrate 15. The holes 22 communicate with the ink supply opening 6 through the manifold 8. The holes 23 communicate with the ink ejection opening 7 through the manifold 8.

In regard to the base substrate 15, a material having a small dielectric constant and a small difference in thermal expansion coefficient from the piezoelectric member 14 is desirable. For example, the base substrate 15 made of a material such as alumina ($Al_2O_3$), a silicon nitride ($Si_3N_4$), a silicon carbide (SiC), an aluminum nitride (AlN), or a piezoelectric zirconate titanate (PZT) is used. In this embodiment, the piezoelectric zirconate titanate (PZT) having a small dielectric constant is used.

The piezoelectric member 14 is obtained by laminating on a first piezoelectric member 14*a* a second piezoelectric member 14*b* having a polarity opposite to that of this first piezoelectric member 14*a*. The first piezoelectric member 14*a* and the second piezoelectric member 14*b* are bonded to each other.

Long grooves 26 connected to the ink ejection path 19 from the ink supply path 18 are formed in the piezoelectric member 14 in parallel. Further, electrodes 21 are provided on inner surfaces of the respective long grooves 26. Each electrode 21 is connected with the driver IC 4 through each wiring line 20.

A space surrounded by each long groove 26 and a back surface of the nozzle plate 16 bonded to the upper side of the second piezoelectric member 14*b* to cover each long groove 26 functions as a pressure chamber 24. Furthermore, the nozzle 2 communicates with each pressure chamber 24 in a one-to-one relationship.

The piezoelectric member 14 forming a partition wall between the pressure chambers 24 adjacent to each other is sandwiched between the electrodes 21 of the respective pressure chambers 24. As a result, an actuator 25 is constituted by the piezoelectric member 14 and the electrodes 21 provided on both sides of this member 14.

When an electric field is applied by a drive signal generated in the driver IC 4, the actuator 25 shear-deforms into a sideling V shape with a joint portion between the first piezoelectric member 14*a* and the second piezoelectric member 14*c* being used as a vertex. Based on this deformation of the actuator 25, a volume of the pressure chamber 24 changes, and the ink provided in the pressure chamber 24 is pressurized. The pressurized ink is ejected from the nozzle 2 communicating with this pressure chamber 24.

In regard to the piezoelectric member 14, a piezoelectric zirconate titanate (PZT), a lithium niobate (LiNbO3), or a lithium tantalite (LiTaO3) is used as a material. In this embodiment, the piezoelectric zirconate titanate (PZT) having a high piezoelectric constant is used.

The electrode 21 has a double structure of nickel (Ni) and gold (Au). The electrode 21 is uniformly generated in the long groove 26 by a plating method. Besides the plating method, a sputtering method or a vapor deposition method can be used as the method of generating the electrode 21. The pressure chambers 24 are formed into a shape having a depth of 300 μm and a width of 80 μm and aligned with a pitch of 169 μm.

In the nozzle plate 16, the nozzles 2 are formed at positions offset every three cycles from the central part of the pressure chambers 24 in the longitudinal direction. As the nozzle plate 16, a metal material such as stainless, an inorganic material such as single crystal silicon, or a resin material such as polyimide is used. In this embodiment, a polyimide film is used.

The nozzles 2 are formed by bonding the nozzle plate 16 to the piezoelectric member 14 and then performing hole drilling by using an excimer laser. The nozzle 2 has a shape tapered from the back surface side of the pressure chamber 24 side toward the front surface side of the ink ejection side.

When a material of the nozzle plate 16 is stainless, the nozzles 2 can be formed by press work. When a material of the nozzle plate 16 is single crystal silicon, the nozzles 2 can be formed by dry etching or wet etching based on photolithography.

In the following description, a portion which is a combination of one actuator 25, the pressure chamber 24 having one sidewall formed by this actuator 25, and the nozzle 2 communicating with this pressure chamber 24 will be called a channel.

The respective channels are divided into three groups "a", "b", and "c". Specifically, in FIG. 4, the channels are divided to be discriminated by reference numerals having a sign "a", "b", or "c" affixed thereto. That is, assuming that a given channel belongs to the group "b", the channels are divided in such a manner that a channel which is adjacent to one side of this channel belongs to the group "a", and a channel adjacent to the other side of the same belongs to the group "c". As a result, every two channels, i.e., three channels including a middle channel and channels adjacent thereto on the left and right sides form one group. In other words, the respective channels are divided into (n+1) groups at intervals of n channels.

The driver IC 4 divides drive signals, which are supplied to the respective channels, into three signals, i.e., an A cycle signal, a B cycle signal, and a C cycle signal. Further, the A cycle signal is supplied to the channels belonging to the group "a", the B cycle signal is supplied to the channels belonging to the group "b", and the C cycle signal is supplied to the channels belonging to the groups "c".

As described above, the driver IC 4 drives the respective channels in accordance with each of (n+1) channel groups in a time sharing manner. Therefore, power is not fed to the channels adjacent to each other in the same cycle.

The drive signal includes ejection pulses which are used to generate pressure oscillation for ejecting ink drops from the nozzle 2 in the pressure chamber 24 associated with this nozzle 2. When the ejection pulses are applied to the actuator 25, a volume of the pressure chamber 24 associated with this actuator 25 changes. Based on this change, ink drops are ejected from the nozzle 2 communicating with this pressure chamber 24.

The driver IC 4 outputs up to four ejection pulses in one cycle. That is, the inkjet head 1 can eject up to four ink drops from one channel in one cycle. A printer including the inkjet head 1 performs gradation printing by controlling the number of ink drops in one cycle of each channel.

In the following description, gradation data when not ejecting an ink drop from the channel in one cycle will be called a gradation value "0", and gradation data when ejecting four ink drops from the same in one cycle will be called a gradation value "4".

Figures 5, 6:
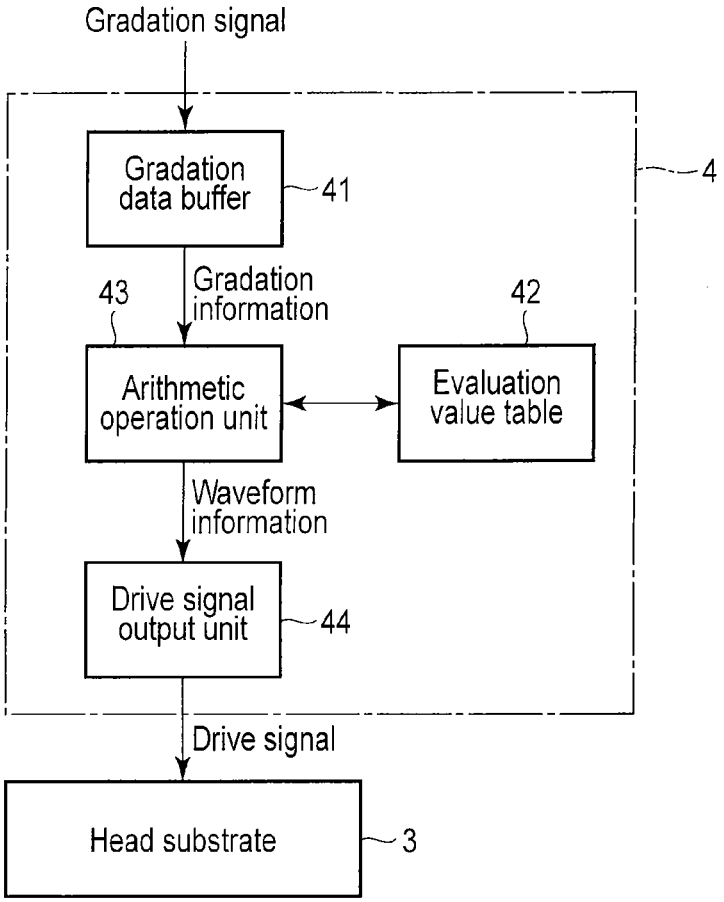
FIG. 5 is a block diagram showing primary structures of a driver IC mounted in the inkjet head.
FIG. 6 is a view showing an evaluation value table included in the driver IC.

FIG. 5 is a block diagram showing primary structures in the driver IC 4. The driver IC 4 comprises a gradation data buffer 41, an evaluation value table 42, an arithmetic operation unit 43, and a drive signal generation unit 44.

When the driver IC 4 receives data of a print image from the outside, e.g., a host computer that controls the inkjet printer, it stores a gradation value of this data in the gradation data buffer 41. The gradation data buffer 41 stores gradation values of print data of at least recent three cycles before.

As shown in FIG. 6, the evaluation value table 42 stores respective evaluation values of one cycle before, two cycles before, and three cycles before in accordance with five gradation values from a gradation value "0" to a gradation value "4".

The gradation value "2" is determined as a reference to set each evaluation value. When a gradation value of previous printing is smaller than the reference gradation value "2", i.e., when the number of ejected ink drops is small, the evaluation value is a positive value. This value tends to increase in the later cycle. Further, the evaluation value is increased as the number of ejected ink drops is reduced, i.e., as the gradation value is reduced.

Conversely, when a gradation value of previous printing is larger than the reference gradation value "2", i.e., when the number of ejected ink drops is large, the evaluation value is a negative value. This value tends to increase in the later cycle. Furthermore, the evaluation value is increased as the number of ejected ink drops is increased, i.e., as the gradation value is increased.

In this embodiment, the respective evaluation values of one cycle before, two cycles before, and three cycles before are set to "0" with respect to the reference gradation value "2". Moreover, the evaluation value of one cycle before is set to "5", the evaluation value of two cycles before is set to "3", and the evaluation value of three cycles before is set to "2" with respect to the gradation value "1" smaller than this gradation value "2". Additionally, the evaluation value of one cycle before is set to "10", the evaluation value of two cycles before is set to "6", and the evaluation value of three cycles before is set to "4" with respect to the further smaller gradation value "0".

Conversely, the evaluation value of one cycle before is set to "−5", the evaluation value of two cycles before is set to "−3", and the evaluation value of three cycles before is set to "−2" with respect to the gradation value "3" larger than the gradation value "2". The evaluation value of one cycle before is set to "−10", the evaluation value of two cycles before is set to "−6", and the evaluation value of three cycles before is set to "−4" with respect to the further large gradation value "4".

Figure 7:
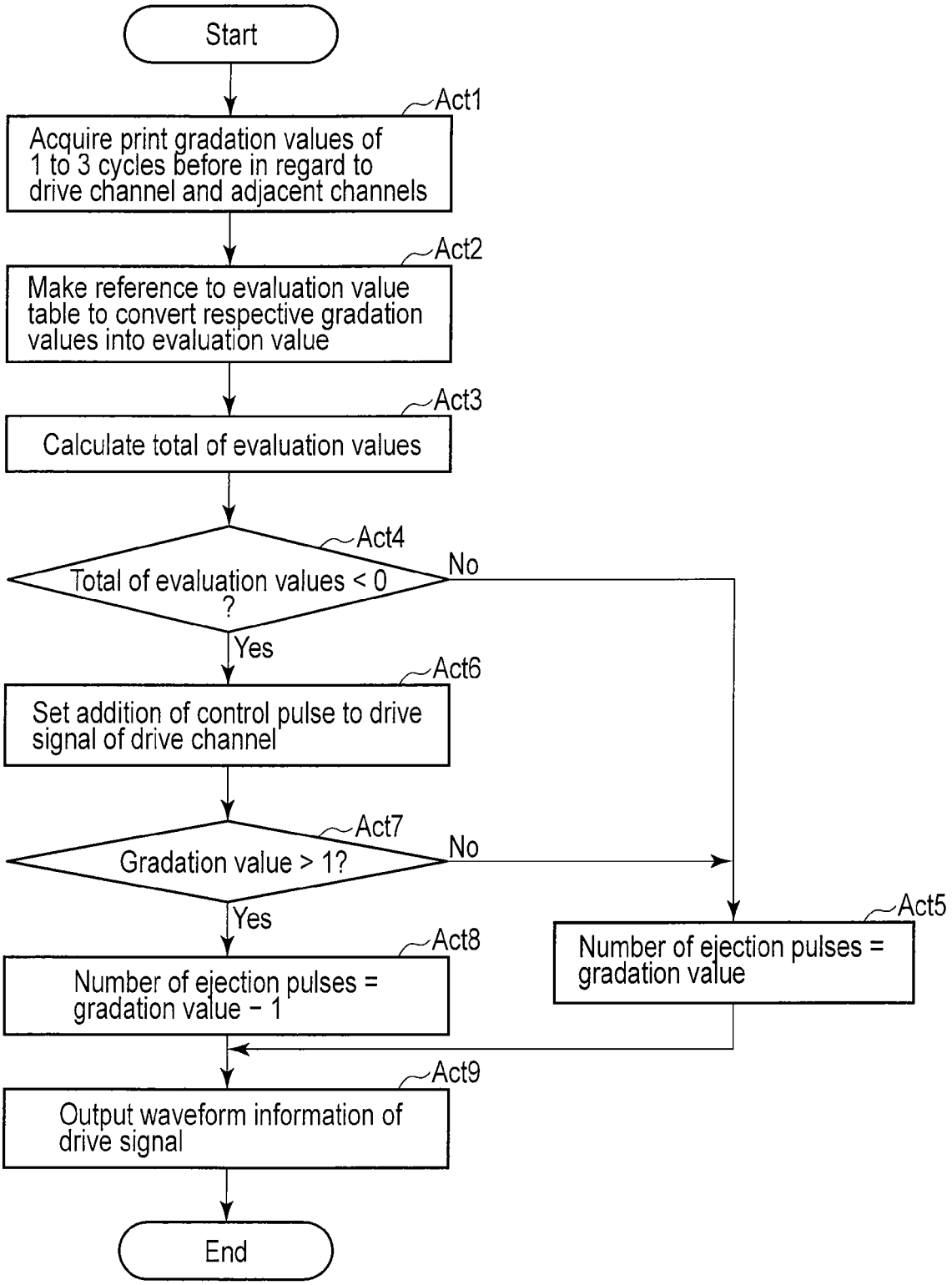
FIG. 7 is a flowchart showing a primary data processing procedure of an arithmetic operation unit included in the driver IC.

The arithmetic operation unit 43 executes arithmetic processing using a procedure shown in a flowchart of FIG. 7 in accordance with each print cycle. First, the arithmetic operation unit 43 acquires gradation values of print data of one to three recent cycles before from the gradation data buffer 41 in regard to a drive channel and adjacent channels on both sides of this drive channel (Act 1).

As described above, the drive signals are divided into three signals, i.e., the A cycle signal, the B cycle signal, and the C cycle signal. Additionally, each cycle signal is supplied to three adjacent channels in accordance with each print cycle in a time sharing manner. Therefore, in the processing of Act 1, the arithmetic operation unit 43 acquires a total of three gradation values, i.e., a gradation value of print data of three cycles before supplied to the drive channel, a gradation value of print data of two cycles before supplied to one adjacent channel, and a gradation value of print data of one cycle before supplied to the other adjacent channel from the gradation data buffer 4.

Then, the arithmetic operation unit 43 makes reference to the evaluation value table 42 to convert all the acquired gradation values into evaluation values (Act 2). Further, the arithmetic operation unit 43 adds up the converted evaluation values to calculate a total value of the evaluation values (Act 3).

For example, it is assumed that the gradation value of the print data of one cycle before is "1", the gradation value of the print data of two cycles before is "3", and the gradation value of the print data of three cycles before is "4". Then, the gradation value of the print data of one cycle before is converted into the evaluation value "5", the gradation value of the print data of two cycles before is converted into the evaluation value "−3", and the gradation value of the print data of three cycles before is converted into "−4". Therefore, the arithmetic operation unit 43 calculates a total value "−2" of the evaluation values.

Subsequently, the arithmetic operation unit 43 determines whether the total value of the evaluation values is a negative value (Act 4: the pulse addition determination unit). When the total value of the evaluation values is not a negative value, i.e., when it is "0" or a positive value, the number of ink drops ejected from the drive channel and the adjacent channels on both sides of this channel is relatively small in printing of recent one cycle to three cycles before. At this time, the ejection rate of the ink drops ejected from the drive channel is stable. Therefore, in the current print cycle, a control pulse required to intensify pressure oscillation does not have to be added to the drive signal in this print cycle.

Thus, when the total value of the evaluation values is not a negative value (NO in Act 4), the arithmetic operation unit 43 sets the number of ink drops ejected from the drive channel to be equal to the gradation value in the current print cycle (Act 5: the ejection pulse number decision unit). That is, if the gradation value is "0", the number of ink drops is also "0". If the gradation value is "1", the number of ink drops is also "1". This is also applied to a situation where the gradation value is "2", "3", or "4".

The arithmetic operation unit 43 generates waveform information of the drive signal including ejection pulses whose number coincides with this gradation value (the drive signal generation unit). Further, the arithmetic operation unit 43 outputs this waveform information to the drive signal generation unit 44 (Act 9).

On the other hand, when the total value of the evaluation values is a negative value, the number of ink drops ejected from the drive channel and the adjacent channels on both sides is relatively large in printing of recent one cycle to three cycles before. At this time, the ejection rate of ink drops ejected from the drive channel is reduced. Therefore, in the current print cycle, to increase the ejection rate of the ink drops, the control pulse must be added to the drive signal.

Therefore, when the total value of the evaluation values is a negative value (YES in Act 4), the arithmetic operation unit 43 generates and temporarily stores information indicating that the control pulse is added to the drive signal having ejection pulses (Act 6). Then, the arithmetic operation unit 43 determines whether the gradation value is larger than "1" (Act 7).

When the gradation value is "1" or "0" (NO in Act 7), the arithmetic operation unit 43 sets the number of ink drops ejected from the drive channel to be equal to the gradation value in the current print cycle (Act 5: the ejection pulse number decision unit). Furthermore, the arithmetic operation unit 43 generates waveform information of the drive signal including a control pulse and ejection pulses whose number is equal to this gradation value (the drive signal generation unit) and outputs this generated information to the drive signal generation unit 44 (Act 9).

On the other hand, when the gradation value is larger than "1" (YES in Act 7), the arithmetic operation unit 43 sets the number of ink drops ejected from the drive channel to a number obtained by subtracting "1" from the gradation value (Act 8: the ejection pulse number decision unit). Moreover, the arithmetic operation unit 43 generates waveform information of the drive signal including a control pulse and ejection pulses whose number is obtained by subtracting "1" from this gradation value (the drive signal generation unit) and outputs the generated information to the drive signal generation unit 44 (Act 9).

The drive signal generation unit 44 outputs the drive signal including a pulse waveform of the waveform information supplied from the arithmetic operation unit 43 to the head main body 3 (the drive signal generation unit).

Figure 8:
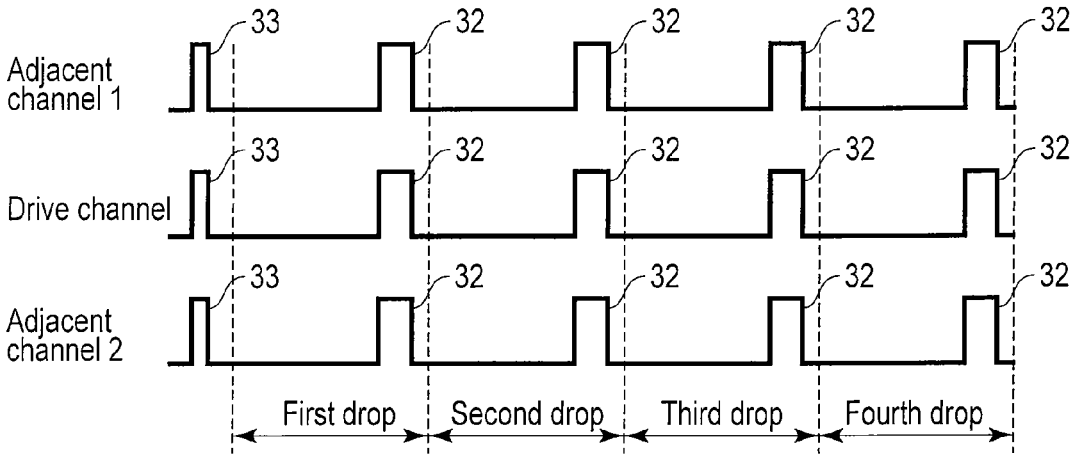
FIG. 8 is a waveform chart showing drive signals when not ejecting ink from a drive channel in an embodiment.
Figure 9:
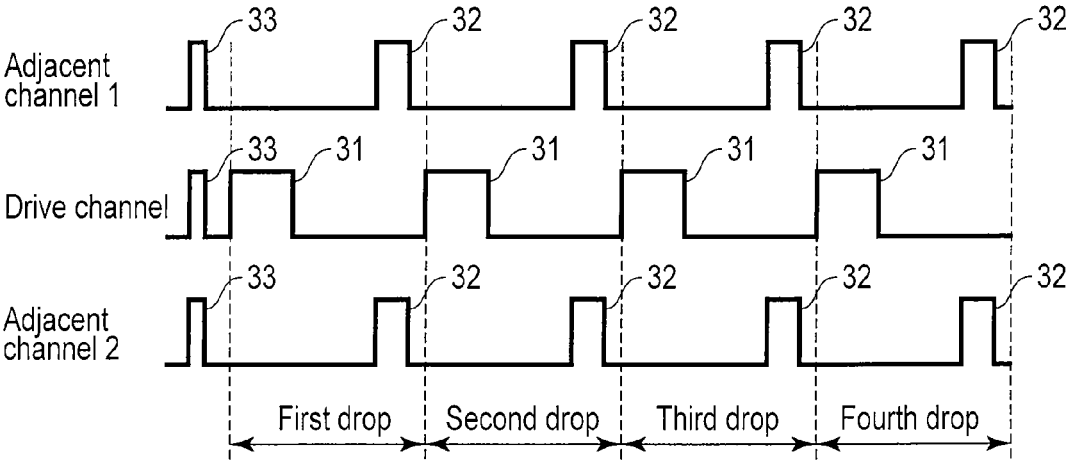
FIG. 9 is a waveform chart showing drive signals when ejecting four ink drops from a drive channel without applying a voltage of a control pulse to an actuator for the drive channel in an embodiment.
Figure 10:
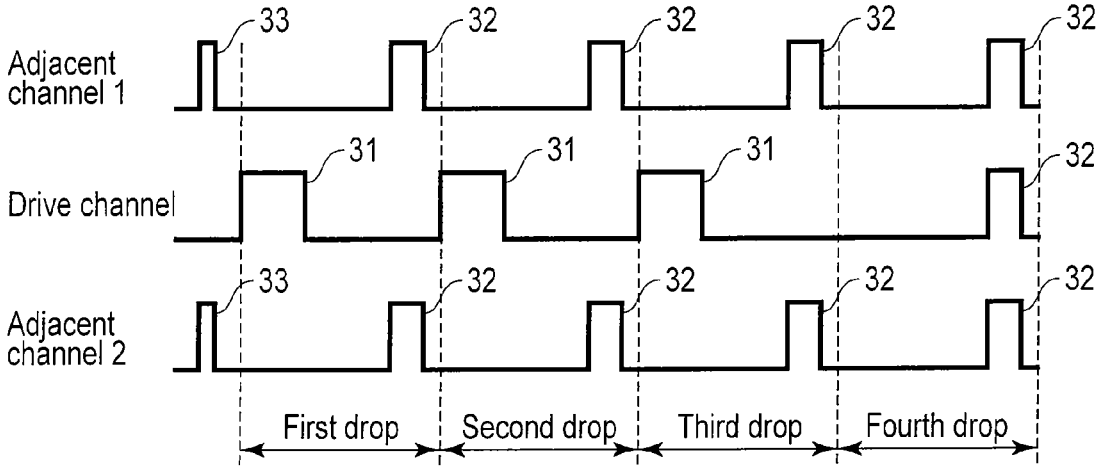
FIG. 10 is a waveform chart showing drive signals when applying the voltage of the control pulse to the actuator for the drive channel and ejecting four ink drops from the drive channel in an embodiment.

Each of FIG. 8, FIG. 9, and FIG. 10 shows an example drive waveforms output to the drive channel and the adjacent channels on both sides of this channel by the driver IC 4. FIG. 8 shows an example when not ejecting ink from the drive channel. FIG. 9 shows an example when ejecting four ink drops from the drive channel without applying a voltage of the control pulse to the actuator 25 of the drive channel. FIG. 10 shows an example when applying a voltage of the control pulse to the actuator 25 of the drive channel and ejecting three ink drops from the drive channel.

In FIG. 8, FIG. 9, and FIG. 10, a pulse waveform 31 represents an ejection pulse, a pulse waveform 32 represents a cancellation pulse, and a pulse waveform 33 is a control pulse. The ejection pulse 31 generates pressure oscillation required to eject ink drops. The cancellation pulse 32 attenuates the pressure oscillation generated by the ejection pulse 31 after ejection of ink drops. The control pulse 33 intensifies the pressure oscillation required for ejecting ink drops.

As shown in FIG. 8, when not ejecting ink from the drive channel, the control pulse 33 is output immediately before a first drop to both the drive channel and the adjacent channels. Moreover, after this output, the cancellation pulse 32 is periodically output in regard to the first drop to a fourth drop.

As shown in FIG. 9, when ejecting four ink drops from the drive channel without applying a voltage of the control pulse to the actuator 25 of the drive channel, first, the control pulse 33 is output immediately before the first drop to the drive channel and the adjacent channels. Subsequently, the ejection pulse 31 is periodically output to the drive channel in regard to the first drop to the fourth drop. The cancellation pulse 32 is periodically output to both the adjacent channels in regard to the first drop to the fourth drop. The cancellation pulse 32 is output after outputting the ejection pulse 32.

As described above, in this embodiment, the control pulses 33 are simultaneously output to the drive channel and the adjacent channels on both sides of this drive channel. As a result, the voltage of the control pulse is not applied to the actuator 25 of the drive channel.

As shown in FIG. 10, when applying the voltage of the control pulse to the actuator 25 of the drive channel and ejecting three ink drops from the drive channel, the control pulse 33 is first output to both the adjacent channels immediately before the first drop. The control pulse 33 is not output to the drive channel.

Then, the ejection pulse 31 is periodically output to the drive channel in regard to the first drop to the third drop, and the cancellation pulse 32 is output to the same for the fourth drop. On the other hand, the cancellation pulse 32 is periodically output to both the adjacent channels on both sides for the first drop to the fourth drop. The cancellation pulse 32 is output after outputting the ejection pulse 31.

As described above, in this embodiment, the control pulses 33 are simultaneously output to the adjacent channels on both sides of the drive channel, and the control pulse 33 is not output to the drive channel. Adopting this configuration enables the voltage of the control pulse to be applied to the actuator 25 of the drive channel.

Additionally, in this embodiment, when applying the voltage of the control pulse to the actuator 25 of the drive channel, the number of ejection pulses for the drive channel is corrected. Specifically, the correction is performed in such a manner that "1" is subtracted from a number determined based on the gradation value, i.e., "1" is subtracted from the number of ink drops ejected from the drive channel.

Figure 11:
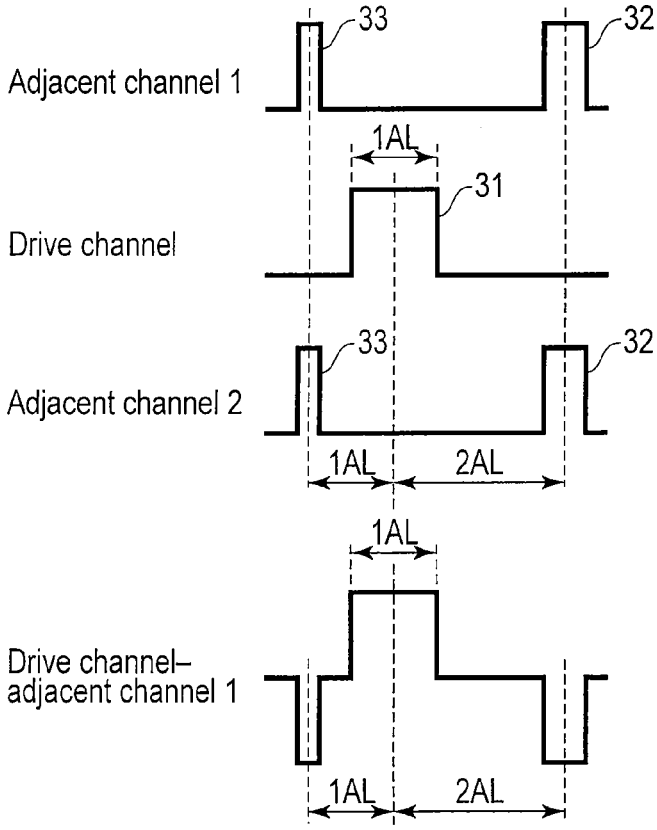
FIG. 11 is a view for explaining a timing of a signal output when applying the voltage of the control pulse to the actuator for the drive channel in an embodiment.

Here, output timings for the ejection pulse 31, the cancellation pulse 32, and the control pulse 33 will now be described with reference to FIG. 11. FIG. 11 is a signal waveform diagram of the drive channel and both the adjacent channels when applying a voltage of the control pulse to the actuator 25 of the drive channel. Additionally, FIG. 11 also shows a waveform of a signal obtained by subtracting a signal supplied to one adjacent signal from a signal supplied to the drive channel.

As shown in FIG. 11, a time interval between a temporal center of the ejection pulse 31 supplied to the drive channel and a temporal center of the cancellation pulse 32 subsequently supplied to each of both the adjacent channels is set to "2AL". Further, a time interval between the temporal center of the ejection pulse 31 supplied to the drive channel and a temporal center of the control pulse 33 supplied to each of both the adjacent channels before the ejection pulse 31 is set to "1AL". Here, a character string "AL" represents a time which is ½ of a main acoustic resonant period of the ink in the pressure chamber 24.

When the output timings of the ejection pulse 31, the cancellation pulse 32, and the control pulse 33 are set in this manner, an effect of each pulse can be greatly improved.

[Table 1] shows a combination example of gradation values for three cycles of each of recent print patterns (a pattern "1" to a pattern "9") and a relationship between a total of evaluation values for the print pattern and presence/absence of addition of the control pulse and correction of ink drops.

TABLE 1

| | Gradation value of last printing | | | | |
|---|---|---|---|---|---|
| Pattern | Three cycles before | Two cycles before | One cycle before | Total of evaluation values | Pulse addition and drop number correction |
| 1 | 0 | 0 | 0 | 20 | "—" |
| 2 | 2 | 2 | 2 | 0 | "—" |
| 3 | 4 | 4 | 4 | −20 | "○" |
| 4 | 0 | 2 | 4 | −6 | "○" |
| 5 | 2 | 4 | 0 | 4 | "—" |
| 6 | 4 | 0 | 2 | 2 | "—" |
| 7 | 0 | 4 | 2 | −2 | "○" |
| 8 | 2 | 0 | 4 | −4 | "○" |
| 9 | 4 | 2 | 0 | 6 | "—" |

The print pattern "1" corresponds to a case where the print gradation value of three cycles before is "0", the print gradation value of two cycles before is "0", and the print gradation value of one cycle before is "0". In this case, based on the set data in the evaluation value table 42, when the print gradation value of three cycles before is "0", the evaluation value is "4". When the print gradation value of two cycles before is "0", the evaluation value is "6". When the print gradation value of one cycle before is "0", the evaluation value is "10". Therefore, a total of the evaluation values is "20". When the total of the evaluation values is a positive value in this manner, the driver IC 4 does not add the control pulse and does not correct the number of ink drops either.

The print pattern "2" corresponds to a case where the print gradation value of three cycles before is "2", the print gradation value of two cycles before is "2", and the print gradation value of one cycle before is "2". In this case, based on the set data in the evaluation value table 42, when the print gradation value of three cycles before is "2", the evaluation value is "0". When the print gradation value of two cycles before is "2", the evaluation value is "0". When the print gradation value of one cycle before is "2", the evaluation value is "0". Therefore, a total of the evaluation values is "0". When the total of the evaluation values is not a negative value in this manner, the driver IC 14 does not add the control pulse and does not correct the number of ink drops either.

The print pattern "3" corresponds to a case where the print gradation value of three cycles before is "4", the print gradation value of two cycles before is "4", and the print gradation value of one cycle before is "4". In this case, based on the set data in the evaluation value table 42, when the print gradation value of three cycles before is "4", the evaluation value is "−4". When the print gradation value of two cycles before is "4", the evaluation value is "−6". When the print gradation value of one cycle before is "4", the evaluation value is "−10". Therefore, a total of the evaluation values is "−20". When the total of the evaluation values is a negative value in this manner, the driver IC 14 adds the control pulse and also corrects the number of ink drops.

The print pattern "4" corresponds to a case where the print gradation value of three cycles before is "0", the print gradation value of two cycles before is "2", and the print gradation value of one cycle before is "4". In this case, based on the set data in the evaluation value table 42, when the print gradation value of three cycles before is "0", the evaluation value is "4". When the print gradation value of two cycles before is "2", the evaluation value is "0". When the print gradation value of one cycle before is "4", the evaluation value is "−10". Therefore, a total of the evaluation values is "−6". When the total of the evaluation values is a negative value in this manner, the driver IC 14 adds the control pulse and also corrects the number of ink drops.

The print pattern "5" corresponds to a case where the print gradation value of three cycles before is "2", the print gradation value of two cycles before is "4", and the print gradation value of one cycle before is "0". In this case, based on the set data in the evaluation value table 42, when the print gradation value of three cycles before is "2", the evaluation value is "0". When the print gradation value of two cycles before is "4", the evaluation value is "−6". When the print gradation value of one cycle before is "0", the evaluation value is "10". Therefore, a total of the evaluation values is "4". When the total of the evaluation values is a positive value in this manner, the driver IC 14 does not add the control pulse and does not correct the number of ink drops either.

The print pattern "6" corresponds to a case where the print gradation value of three cycles before is "4", the print gradation value of two cycles before is "0", and the print gradation value of one cycle before is "2". In this case, based on the set data in the evaluation value table 42, when the print gradation value of three cycles before is "4", the evaluation value is "−4". When the print gradation value of two cycles before is "0", the evaluation value is "6". When the print gradation value of one cycle before is "2", the evaluation value is "0". Therefore, a total of the evaluation values is "2". When the total of the evaluation values is a positive value in this manner, the driver IC 14 does not add the control pulse and does not correct the number of ink drops either.

The print pattern "7" corresponds to a case where the print gradation value of three cycles before is "0", the print gradation value of two cycles before is "4", and the print gradation value of one cycle before is "2". In this case, based on the set data in the evaluation value table 42, when the print gradation value of three cycles before is "0", the evaluation value is "4". When the print gradation value of two cycles before is "4", the evaluation value is "−6". When the print gradation value of one cycle before is "2", the evaluation value is "0". Therefore, a total of the evaluation values is "−2". When the total of the evaluation values is a negative value in this manner, the driver IC 14 adds the control pulse and also corrects the number of ink drops.

The print pattern "8" corresponds to a case where the print gradation value of three cycles before is "2", the print gradation value of two cycles before is "0", and the print gradation value of one cycle before is "4". In this case, based on the set data in the evaluation value table 42, when the print gradation value of three cycles before is "2", the evaluation value is "0". When the print gradation value of two cycles before is "0", the evaluation value is "6". When the print gradation value of one cycle before is "4", the evaluation value is "−10". Therefore, a total of the evaluation values is "−4". When the total of the evaluation values is a negative value in this manner, the driver IC 14 adds the control pulse and also corrects the number of ink drops.

The print pattern "9" corresponds to a case where the print gradation value of three cycles before is "4", the print gradation value of two cycles before is "2", and the print gradation value of one cycle before is "0". In this case, based on the set data in the evaluation value table 42, when the print gradation value of three cycles before is "4", the evaluation value is "−4". When the print gradation value of two cycles before is "2", the evaluation value is "0". When the print gradation value of one cycle before is "0", the evaluation value is "10". Therefore, a total of the evaluation values is "6". When the total of the evaluation values is a positive value in this manner, the driver IC 14 does not add the control pulse and does not correct the number of ink drops either.

As shown in [Table 1], in this embodiment, when a total of the evaluation values is a negative value, the control pulse 33 is added, and the number of ink drops is corrected. On the other hand, when a total of the evaluation values is not lower than 0, the control pulse 33 is not added, and the number of ink drops is not corrected either.

Figure 12:
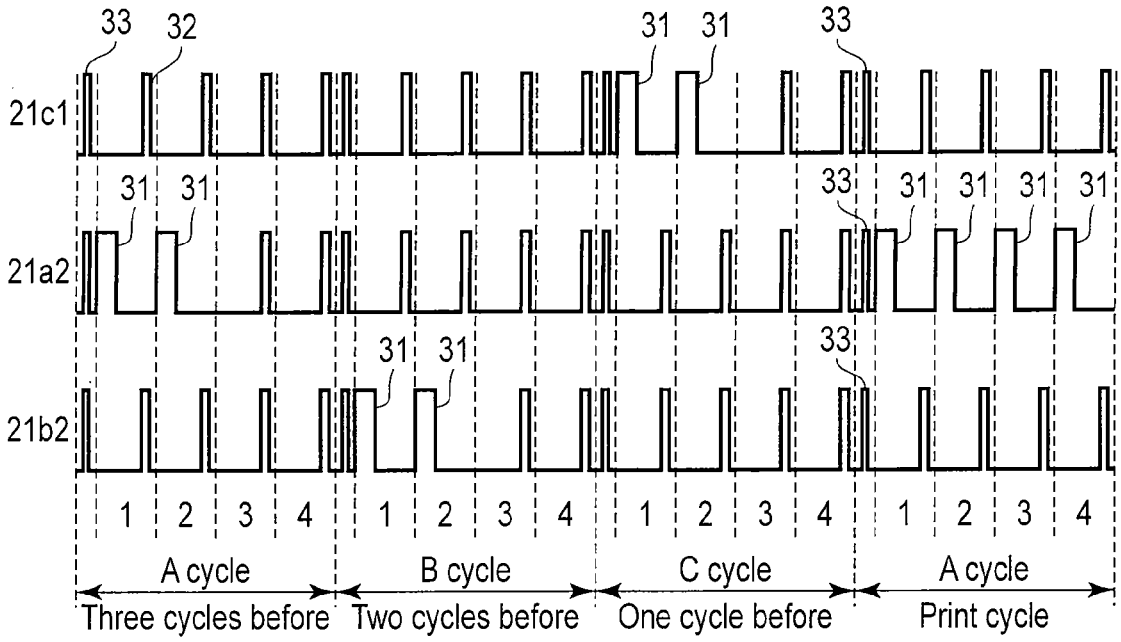
FIG. 12 is a waveform chart showing an example of drive signals in an embodiment.

FIG. 12 is a waveform chart of drive signals applied to an electrode 21*c*1, an electrode 21*a*2, an electrode 21*b*2 when performing printing of the print gradation value "4" from a nozzle 2*a*2 immediately after the print pattern "2" in [Table 1].

The print pattern "2" corresponds to the case where the print gradation value of three cycles before is "2", the print gradation value of two cycles before is "2", and the print gradation value of one cycle before is "2". Therefore, in FIG. 12, in an A cycle of three cycles before, two ejection pulses 31 are output to electrode 21*a*2 of the drive channel. In a B cycle of two cycles before, two ejection pulses 31 are output to electrode 21*b*2 of one adjacent channel. In a C cycle of one cycle before, two ejection pulses 31 are output to electrode 21*c*1 of the other adjacent channel.

As shown in [Table 1], the driver IC 4 does not add the control pulse and does not correct the number of ink drops either immediately after the print pattern "2". That is, a voltage of the control pulse 33 is not applied to actuators 25*c*1 and 25*a*2 constituting both sidewalls of the drive channel. Therefore, the control pulse 33 is output to the respective electrodes 21*c*1, 21*a*2, and 21*b*2 immediately before the print cycle (the A cycle).

Outputting this pulse equalizes potentials in electrode 21*c*1, electrode 21*a*2, and electrode 21*b*2. Therefore, an electric field of the control pulse 33 does not function with respect to actuator 25*c*1 and actuator 25*a*2. Further, the number of ink drops is not corrected. Therefore, in the print cycle, the ejection pulses 31 associated with the gradation value "4" in number are output to electrode 21*a*2, thereby ejecting four ink drops.

Figure 13:
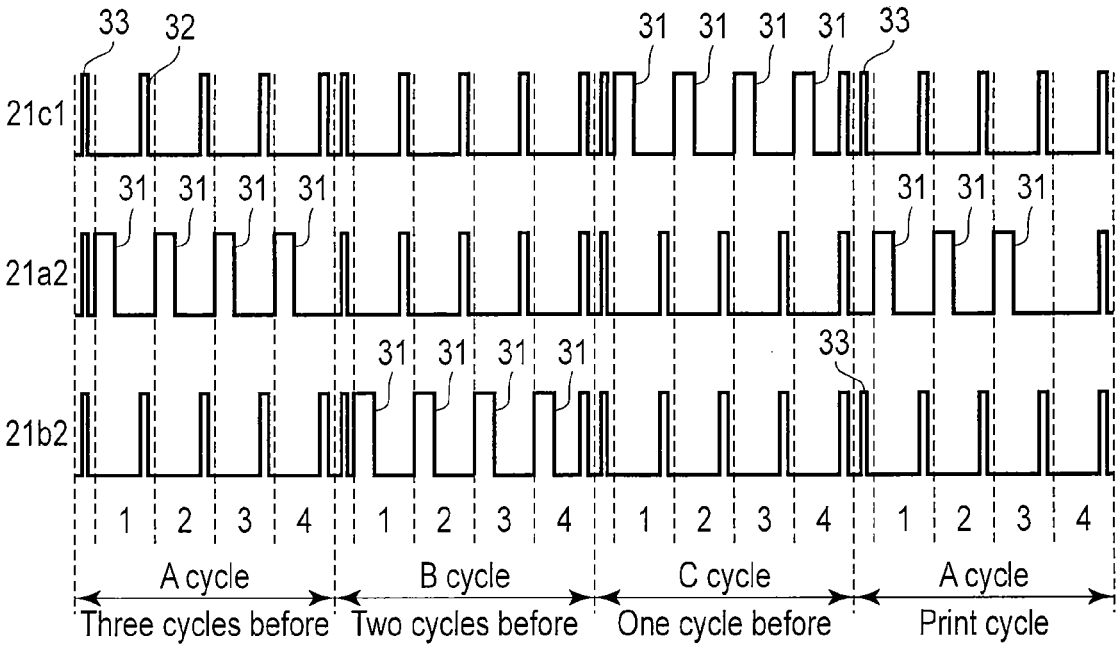
FIG. 13 is a view showing another example of drive signal in an embodiment.

FIG. 13 is a waveform chart of drive signals applied to electrode 21*c*1, electrode 21*a*2, and electrode 21*b*2 when performing printing of the print gradation value "4" from nozzle 2*a*2 immediately after the print pattern "3" in [Table 1].

The print pattern "4" corresponds to the case where the print gradation value of three cycles before is "4", the print gradation value of two cycles before is "4", and the print gradation value of one cycle before is "4". Therefore, in FIG. 13, in the A cycle of three cycles before, four ejection pulses 31 are output to electrode 21*a*2 of the drive channel. In the B cycle of two cycles before, four ejection pulses 31 are output to electrode 21*b*2 of one adjacent channel. In the C cycle of one cycle before, four ejection pulses 31 are output to electrode 21*c*1 of the other adjacent channel.

As shown in [Table 1], the driver IC 4 adds the control pulse and also corrects the number of ink drops immediately after the print pattern "4". That is, a voltage of the control pulse 33 is applied to actuators 25*c*1 and 25*a*2 constituting both the sidewalls of the drive channel. Therefore, the control pulse 33 is output to the respective electrodes 21*c*1 and 21*b*2 immediately before the print cycle (the A cycle). The control pulse 33 is not output to electrode 21*a*2.

Then, potential differences are generated between electrode 21*c*1 and electrode 21*a*2 and between electrode 21*a*2 and electrode 21*b*2. Therefore, an electric field of the control pulse 33 functions with respect to actuator 25*c*1 and actuator 25*a*2. Further, the number of ink drops is corrected. Therefore, in the print cycle, "3" ejection pulses 31, the number of which is a result of subtracting "1" from the gradation value "4", are output to electrode 21*a*2, thereby ejecting three ink drops.

As described above, in this embodiment, when the control pulse 33 is generated and the gradation value is not smaller than "2", the number of times of generation of the ejection pulses 31 is adjusted to be "1" smaller than the gradation value. That is because the ejection volume of ink drops tends to increase when the control pulse 33 is generated, and the ejection volume is further increased when the control pulse 33 is applied.

At the time of applying the control pulse 33 to the actuator 25, reducing the number of ink drops enables the ejection volume of the ink drops to be reduced. As a result, a variation in the ejection volume can be suppressed.

It is to be noted that the correction of ink drops is performed in such a manner that the corrected number of ink drops becomes 1 or above at minimum. That is, when the gradation value is "1", the correction of ink drops is not performed.

[Table 2] shows variations in ink ejection volume and ink ejection rate when the ink ejection rate is not corrected by using the control pulse 33 in the above-described print patterns "1" to "9".

TABLE 2

| | Gradation value of last printing | | | Variation in liquid droplets from reference | |
|---|---|---|---|---|---|
| Pattern | Three cycles before | Two cycles before | One cycle before | Ejection volume [pl] | Ejection rate [m/s] |
| 1 | 0 | 0 | 0 | −0.7 | 5.6 |
| 2 | 2 | 2 | 2 | 1.0 | 0.7 |
| 3 | 4 | 4 | 4 | 6.1 | −2.3 |
| 4 | 0 | 2 | 4 | 4.7 | −0.6 |
| 5 | 2 | 4 | 0 | −0.4 | 2.1 |
| 6 | 4 | 0 | 2 | 0.5 | 0.9 |
| 7 | 0 | 4 | 2 | 4.1 | −1.5 |
| 8 | 2 | 0 | 4 | 3.8 | −0.7 |
| 9 | 4 | 2 | 0 | 2.1 | 0.2 |
| Variation range | | | | 6.8 | 7.9 |

Further, [Table 3] shows variations in ink ejection volume and ink ejection rate when the ink ejection rate is corrected by the control pulse 33 but the number of ink drops is not corrected.

TABLE 3

| | Gradation value of last printing | | | Variation in liquid droplets from reference | |
|---|---|---|---|---|---|
| Pattern | Three cycles before | Two cycles before | One cycle before | Ejection volume [pl] | Ejection rate [m/s] |
| 1 | 0 | 0 | 0 | −0.7 | 5.6 |
| 2 | 2 | 2 | 2 | 1.0 | 0.7 |
| 3 | 4 | 4 | 4 | 8.4 | 0.5 |
| 4 | 0 | 2 | 4 | 6.7 | 0.8 |
| 5 | 2 | 4 | 0 | −0.4 | 2.1 |
| 6 | 4 | 0 | 2 | 0.5 | 0.9 |
| 7 | 0 | 4 | 2 | 6.1 | −0.3 |
| 8 | 2 | 0 | 4 | 5.9 | −0.8 |
| 9 | 4 | 2 | 0 | 2.1 | 0.2 |
| Variation range | | | | 9.1 | 5.3 |

Furthermore, [Table 4] shows variations in ink ejection volume and ink ejection rate when the ink ejection rate is corrected and the number of ink drops is corrected by the control pulse 33.

TABLE 4

| | Gradation value of last printing | | | Variation in liquid droplets from reference | |
|---|---|---|---|---|---|
| Pattern | Three cycles before | Two cycles before | One cycle before | Ejection volume [pl] | Ejection rate [m/s] |
| 1 | 0 | 0 | 0 | −0.7 | 5.6 |
| 2 | 2 | 2 | 2 | 1.0 | 0.7 |
| 3 | 4 | 4 | 4 | 0.4 | 0.5 |
| 4 | 0 | 2 | 4 | −1.3 | −0.8 |
| 5 | 2 | 4 | 0 | −0.4 | 2.1 |
| 6 | 4 | 0 | 2 | 0.5 | 0.9 |
| 7 | 0 | 4 | 2 | −1.9 | 0.3 |
| 8 | 2 | 0 | 4 | −2.1 | −0.8 |
| 9 | 4 | 2 | 0 | 2.1 | 0.2 |
| Variation range | | | | 4.2 | 5.3 |

As shown in [Table 4], in this embodiment, the variations in ejection volume and ejection rate due to a difference in the last printing patterns are 4.2 pl and 5.3 m/s, respectively. On the other hand, as shown in [Table 3], the variations in ejection volume and ejection rate when the control pulse is corrected but the number of ink drops is not corrected are 9.1 pl and 5.3 m/s, respectively. Furthermore, as shown in [Table 2], the variations in ejection volume and ejection rate when the control pulse is not controlled and the number of ink drops is not corrected either are 6.8 pl and 7.9 m/s, respectively.

As described above, according to this embodiment, when the control pulse is corrected and the number of ink drops is also corrected, variations in both ejection rate and ejection volume of the ink drops can be sufficiently suppressed.

In the foregoing embodiment, the description has been given as to the configuration where the ink supply path 18 is provided at one end of the pressure chamber 24, the ink ejection path 19 is provided at the other end of the same, and the nozzles 2 are provided at the central part of the pressure chamber 24. However, the application range of the present invention is not restricted thereto, and a configuration where the nozzles are provided at one end of the pressure chamber 24 and the ink supply path is provided at the other end can be also applied.

Moreover, the number of ink drops is reduced by "1" when correcting an ink ejection rate by using the control pulse 33 in this embodiment, the number to be subtracted from the number of ink drops is not restricted to "1". "2" or a higher value may be subtracted from the number of ink drops to correct a ejection volume.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A driving apparatus of an inkjet head having a plurality of pressure chambers arranged in parallel and partitioned by partition walls made of a piezoelectric material, each of the partition walls being sandwiched between a plurality of electrodes arranged on the partition walls, each pressure chamber in fluid communication with a nozzle from which ink is ejected, each partition wall sandwiched between the electrodes forming an actuator shared by two pressure chambers which are in contact with the partition wall, the driving apparatus comprising:

a drive signal output unit which outputs to the actuator a drive signal including ejection pulses that are used to generate pressure oscillation in the pressure chamber for ejecting ink drops from the corresponding nozzle;

an ejection pulse number decision unit which decides the number of ejection pulses for the actuator in a current cycle based on a gradation value of print data for the actuator;

a pulse addition determination unit which determines whether a control pulse that intensifies the pressure oscillation is to be added to the drive signal including the ejection pulses, based on a total of respective evaluation values set in an evaluation table in which, for each gradation value, an evaluation value 0 is set if the gradation value is equal to a reference gradation value, a positive evaluation value whose absolute value is increased as a gradation value is reduced is set if the gradation value is smaller than the reference gradation value, and a negative evaluation value whose absolute value is increased as a gradation value is increased is set if the gradation value is larger than the reference gradation value, the respective evaluation values being stored in the evaluation value table as being associated with the gradation values of the print data for the actuator and adjacent actuators for multiple recent cycles before the current cycle, wherein the pulse addition determination unit determines to not add the control pulse if the total evaluation value is a positive value, and determines to add the control pulse if the total evaluation value is a negative value; and a drive signal generation unit which generates the drive signal including ejection pulses whose number has been decided by the ejection pulse number decision unit when the pulse addition determination unit has determined to not add the control pulse, and generates the drive signal including the control pulse and ejection pulses whose number has been reduced from the number decided by the ejection pulse number decision unit when the pulse addition determination unit has determined to add the control pulse.

2. The apparatus of claim 1, further comprising:

a gradation data buffer configured to store the gradation values of the print data for multiple cycles before the current cycle.

3. The apparatus of claim 1, wherein the pulse addition determination unit determines to not add the control pulse if the total evaluation value is zero.

4. The apparatus of claim 1, wherein the inkjet head is a shared-wall-type head.

5. A driving apparatus of an inkjet head having a plurality of pressure chambers arranged in parallel and partitioned by partition walls made of a piezoelectric material, each of the partition walls being sandwiched between a plurality of electrodes arranged on the partition walls, each pressure chamber in fluid communication with a nozzle from which ink is ejected, each partition wall sandwiched between the electrodes forming an actuator shared by two pressure chambers which are in contact with the partition wall, the driving apparatus comprising:

a drive signal output unit which outputs to the actuator a drive signal including ejection pulses that are used to generate pressure oscillation in the pressure chamber for ejecting ink drops from the corresponding nozzle;

an ejection pulse number decision unit which decides the number of ejection pulses for the actuator in a current cycle based on a gradation value of print data for the actuator;

a pulse addition determination unit which determines whether a control pulse that intensifies the pressure oscillation is to be added to the drive signal including the election pulses; and a drive signal generation unit which generates the drive signal, the drive signal including ejection pulses whose number has been decided by the ejection pulse number decision unit when the pulse addition determination unit has determined to not add the control pulse, and including the control pulse and election pulses whose number has been reduced from the number decided by the ejection pulse number decision unit when the pulse addition determination unit has determined to add the control pulse, wherein the number of ejection pulses in the drive signal is reduced by "1" from the number decided by the ejection pulse number decision unit, when the number decided by the ejection pulse decision unit is not lower than "2".

6. A driving apparatus of an inkjet head having a plurality of pressure chambers arranged in parallel and partitioned by partition walls made of a piezoelectric material, each of the partition walls being sandwiched between a plurality of electrodes arranged on the partition walls, each pressure chamber in fluid communication with a nozzle from which ink is ejected, each partition wall sandwiched between the electrodes forming an actuator shared by two pressure chambers which are in contact with the partition wall, the driving apparatus comprising:

a drive signal output unit which outputs to the actuator a drive signal including ejection pulses that are used to generate pressure oscillation in the pressure chamber for ejecting ink drops from the corresponding nozzle;

an ejection pulse number decision unit which decides the number of ejection pulses for the actuator in a current cycle based on a gradation value of print data for the actuator;

a pulse addition determination unit which determines whether a control pulse that intensifies the pressure oscillation is to be added to the drive signal including the election pulses; and a drive signal generation unit which generates the drive signal, the drive signal including ejection pulses whose number has been decided by the ejection pulse number decision unit when the pulse addition determination unit has determined to not add the control pulse, and including the control pulse and election pulses whose number has been reduced from the number decided by the ejection pulse number decision unit when the pulse addition determination unit has determined to add the control pulse, wherein the drive signal includes a first drive signal for the actuator associated with the pressure chamber of the nozzle from which ink drops are ejected, and second and third drive signals for the actuators associated with the respective pressure chambers of the two nozzles adjacent to both sides of the nozzle from which ink drops are ejected, the first drive signal having the ejection pulses whose number has been decided by the ejection pulse number decision unit, the second and third drive signals having a cancellation signal which attenuates pressure oscillation generated by the ejection pulses after ejection of ink drops, when the pulse addition decision determination unit has determined to not add the control pulse.

7. The apparatus of claim 6, wherein the first drive signal includes the control pulse and the ejection pulses whose number is reduced to be lower than the number decided by the ejection pulse decision unit, and the second and third drive signals include the cancellation signal, when the pulse addition determination unit has determined to add the control pulse.

8. The apparatus of claim 7, wherein wherein the number of ejection pulses in the drive signal is reduced by "1" from the number decided by the ejection pulse number decision unit, when the number decided by the ejection pulse number decision unit is not lower than "2".

9. A driving method for an inkjet head having a plurality of pressure chambers arranged in parallel and partitioned by partition walls made of a piezoelectric material, each of the partition walls being sandwiched between a plurality of electrodes arranged on the partition walls, each pressure chamber in fluid communication with a nozzle from which ink is ejected, each partition wall sandwiched between the electrodes forming an actuator shared by two pressure chambers which are in contact with the partition wall, the method comprising:

deciding, for the actuator in a current cycle, the number of ejection pulses required for generating pressure oscillation in the corresponding pressure chamber for ejecting ink drops from the corresponding nozzle based on a gradation value of print data for the actuator;

determining whether a control pulse that intensifies the pressure oscillation is to be added to a drive signal including the ejection pulses, based on a total of respective evaluation values set in an evaluation table in which, for each gradation value, an evaluation value 0 is set if the gradation value is equal to a reference gradation value, a positive evaluation value whose absolute value is increased as a gradation value is reduced is set if the gradation value is smaller than the reference gradation value, and a negative evaluation value whose absolute value is increased as a gradation value is increased is set if the gradation value is larger than the reference gradation value, the respective evaluation values being stored in the evaluation value table as being associated with the gradation values of the print data for the actuator and adjacent actuators for multiple recent cycles before the current cycle, wherein the control pulse is not added to the drive signal if the total evaluation value is a positive value, and the control pulse is added to the drive signal if the total evaluation value is a negative value;

generating the drive signal, wherein the drive signal includes the ejection pulses whose number has been decided based on the gradation value of the print data when the control pulse has been determined to be not added, and includes the control pulse and the ejection pulses whose number is reduced to be lower than the number decided based on the gradation value of the print data when the control pulse has been determined to be added; and outputting the drive signal to the actuator.

10. The method of claim 9, wherein the control pulse is determined to be not added when the total evaluation value is zero.

11. The method of claim 9, wherein when the number of ejection pulses decided based on the gradation value of the print data is not lower than "2" and the control pulse has been determined to be added, the number of ejection pulses in the drive signal is reduced by "1" from the decided number of ejection pulses.

12. The method of claim 9, wherein the drive signal includes a first drive signal for the actuator associated with the pressure chamber of the nozzle from which ink drops are ejected, and second and third drive signals for the actuators associated with the respective pressure chambers of the two nozzles adjacent to both sides of the nozzle from which ink drops are ejected, the first drive signal including ejection pulses whose number has been decided based on the gradation value of the print data, and the second and third drive signals including a cancellation signal which attenuates pressure oscillation generated by the ejection pulses after ejecting ink drops, when the control pulse has been determined to be not added.

13. The method of claim 12, wherein the first drive signal including ejection pulses whose number is reduced to be lower than the number decided based on the gradation value of the print data, and the second and third drive signals including the cancellation signal, when the control pulse has been determined to be added.

14. The method of claim 13, wherein when the number of ejection pulses decided based on the gradation value of the print data is not lower than "2" and the control pulse has been determined to be added, the number of ejection pulses in the drive signal is reduced by "1" from the decided number of election pulses.

* * * * *